United States Patent [19]

Aubry et al.

[11] Patent Number: 4,708,705

[45] Date of Patent: Nov. 24, 1987

[54] REINFORCED PLASTIC BAG

[76] Inventors: Paul E. Aubry, 361 Rue Baillargeon, Cap-de-la-Madeleine, Quebec, Canada, G8T 6K9; Josef Poklukar, 520 Logan Avenue, St. Lambert, Quebec, Canada, H9P 2R3

[21] Appl. No.: 825,586

[22] Filed: Feb. 3, 1986

Related U.S. Application Data

[63] Continuation-in-part of Ser. No. 578,429, Feb. 9, 1984, abandoned.

[51] Int. Cl.[4] ..... B31B 23/62; B31B 23/72; B31B 23/84

[52] U.S. Cl. ..... 493/211; 493/213; 493/293; 493/297; 493/302; 383/46

[58] Field of Search ..... 493/211, 213, 220, 293, 493/297, 302; 383/44, 46

[56] References Cited

U.S. PATENT DOCUMENTS

| | | | |
|---|---|---|---|
| 2,395,077 | 2/1946 | Southwick | 493/195 |
| 3,130,647 | 4/1964 | Anderson et al. | 493/193 |
| 3,279,330 | 10/1966 | Harding | 493/211 |
| 4,464,157 | 8/1984 | Benoit et al. | 493/211 |

FOREIGN PATENT DOCUMENTS

| | | | |
|---|---|---|---|
| 953259 | 8/1974 | Canada | 383/44 |

*Primary Examiner*—Frederick R. Schmidt
*Assistant Examiner*—William E. Terrell
*Attorney, Agent, or Firm*—Robert J. Schaap; Eric Fincham

[57] ABSTRACT

The invention provides a method of forming single or multi-wall plastic tubing and more particularly, in forming single or multi-wall plastic bags wherein the seal area is strengthened by utilizing a plurality of extruded layers of adhesive material in the seal area. This would particularly be the case for valved bags.

10 Claims, 7 Drawing Figures

REINFORCED PLASTIC BAG

This application is a continuation-in-part of copending application Ser. No. 578,429 filed Feb. 9 1984, abandoned.

The present invention relates to plastic tubing and in particular, to valve bags formed of plastic film material in which these prior art products are made more useful by a novel method of reinforcement using layers of extruded adhesive resins Plastic bags are used for packaging a number of materials and are particularly suitable for dry fluids. These bags are made from tubing formed from plastic film material and when the plastic tubing is formed into a bag, there is often a sealing strip (generally longitudinal) which is subjected to various stresses and/or strains and which strip will ultimately become the weak part of the bag. It is at this point that the valve is formed and breakage at this point of stress or strain frequently results unless the bag is suitably reinforced.

The manufacture of single and double-wall plastic bags is, as aforementioned, well known in the art. In a single wall bag, a sheet of film is folded over longitudinally so that two edges overlap which can then be heat-sealed or glued as appropriate. The heat sealing operation utilizes conventional equipment and in the case of glueing, a thin layer of glue is placed between the two overlapping walls or plies. When utilizing a double wall bag or tube, the overlapping edges of the two plies or walls are offset from each other to allow for the introduction of the heat sealing or glueing equipment. This leads to a generally awkward arrangement and in most instances, an inherent weakness in the construction especially when forming a valve bag.

In the prior art, which will be discussed in greater detail below, the paramount concern was with respect to the adhesion between the two layers. To this end, in conventional arrangements no consideration has been given to the reinforcing at the adhered edges.

Thus, in the prior art, and before hot melts were employed, adhesion was obtained either by heat sealing or by applying with a roller at ambient temperatures a thin layer of a somewhat chemically active bonding agent generally referred to as an adhesive composition. One may refer to U.S. Pat. No. 3,279,330 issued to Harding which teaches, as one of its objectives, the reinforcement of the valve area and this reinforcement is obtained by using an extra layer of film in the form of a cuff to reinforce this valve area. The patentee also teaches extruding thermoplastic resin to bond the various overlapping flaps/edges together. More recently, U.S. Pat. No. 4,464,157 to Benoit uses an extra layer of film to reinforce the handle area. In both these instances, the patentees teach using, only as an adhesive, a hot melt material and employing extra layers of film for reinforcement.

It is therefore an object of the present invention to provide a method for the manufacture of plastic bags/-tubes having edge seals which overcome the above disadvantages.

It is a further object of the present invention to provide an improved apparatus suitable for the manufacture of plastic bags/tubes.

It is a still further object of the present invention to provide a plastic bag having reinforced areas along the edge seals, particularly when valves are used.

In one particular aspect of the present invention, there is provided a method of forming a double wall plastic tubing which includes the steps of feeding first and second layers of a suitable plastic sheet material into proximity with each other. The first and second layers have their side edges generally in alignment with each other with the layers facing each other. Subsequently, a band/layer of extruded reinforcing adhesive material is placed on at least one of the layers at each side edge on facing surfaces. The facing surfaces of the side edges are then placed into contact with each other and pressed together to form a double wall sheet/web reinforced at the edges by a band of said extruded material of predetermined width and thickness. The adhered edges are then folded over on each other in a tubing operation such that the adhered edges overlap each other; they in turn are then secured together in an overlapping configuration.

The plastic sheet materials utilized may be any suitable film of a thermoplastic resinous material capable of being sealed according to the method of the invention. As will be appreciated by those skilled in the art, the preferred material is polyethylene. However, as is also known in the art, the two walls or layers forming the tube may be of a different material—i.e. since two separate plies are utilized in the double bag embodiment, the films may have different thicknesses, be of different materials, and the like. One film may be preprinted such that the other film protects the printed material thereon. The thicknesses of the film will be sufficient for the end use of the product.

As aforementioned, the first and second layers of thermoplastic sheet material are fed such that their side edges are in alignment. The thermoplastic films are then held apart and a reinforcing material is extruded onto at least one of the edges of one of the films such that when the edges are subsequently secured together a band-/layer of reinforcing thermoplastic material of a predetermined width and thickness is bonded in place between the two said layers of sheet material. As will be appreciated, the reinforcing material may be applied onto both of the facing surfaces of the films to increase the quality of the bond as well as the thickness of the final layer.

The extruded reinforcing adhesive material employed may be selected among those well known to those skilled in the art and in a preferred embodiment, is a hot melt adhesive such as that formulated from low density polyethylene. If the films are treated on their surfaces, it may be preferable to leave an untreated surface where the hot melt adhesive is to be applied.

In the present invention wherein the adhesive material is also used as a reinforcing material, it is important to maintain the proper width and thickness of the reinforcing adhesive band. To this end, the width and thickness of the reinforcing material can vary depending on the end use of the product and also on the thickness and nature of the plastic sheet material being reinforced. In general, the band width should be within the range of between 5 to 50 mm and the thickness should not be less than the thickness of a sheet material being employed. However, the thickness attainable depends on the type of resin used, extrusion temperature, and the size and type of die. It has been found that a practical thickness for most uses of the bags is between 2 and 5 mils.

Subsequent to the application of the reinforcing material, the films are subjected to a pressure at least at the edge portions to provide the proper contact at the edges and adhesion thereof. Conveniently, the film may be passed between a pair of pressure rolls to thereby form a pair of reinforcing seams or bands of a predetermined width and thickness at either side edge of the thermoplastic films.

Subsequently the double wall structure is then folded over in a tubing operation as is well known in the art. In the tubing operation, the two secured side edges are overlapped and in turn secured together. To secure the two edge seams together, different methods may be employed. Thus, while one may employ prior art bonding methods, the application of a layer of reinforcing adhesive, i.e. hot melt adhesive, is preferred. It is also within the scope of the invention that a form of reinforcing material can be applied to the exterior surface of at least one of the layers of plastic sheet material which will then secure the double wall structure into a double wall tube.

Utilizing the above method in a double wall structure, it has been found that the final longitudinal seam forming the tube is stronger than the prior art seams. During production, various operations were facilitated due to the construction which appeared to be stiffer on passing through the turntable and registration section on an ender thereby facilitating these operations.

One of the main advantages of the construction is that when the tubing is used as a valve bag, the valve seal is reinforced. In other words, the area or edge where the valve is attached to the tube and is stressed when the filling bag is inserted is a lot stronger than conventional bags and this is particularly true when the bag is used/stored at lower temperatures.

In the manufacture of a valve bag, as is well know, valve components may be inserted to provide a valve structure during the tubing operation. Thus, in one particular embodiment, one or more envelopes or tubes of a suitable material may be interposed between the two secured side edges during the tubing operation. This would then provide an entry into the interior of the bag which is formed by transverse cutting and sealing of the tubes. In one particular embodiment, a pair of valve tubes may be provided; a first one of a relatively short length of a relatively thick material to be secured to the overlapped edges with a longer more flexible inner portion providing the valve entrance per se.

The apparatus adapted to practice the present invention may consist of substantially conventional bag-forming machinery. Thus, there will be provided means for supplying a pair of films, means for guiding the same into proximity with each other, means for extruding a layer of hot melt reinforcing adhesive between the edges of the films, means for securing the films together and conventional tubing means.

The method of the invention can also be applied to single wall bags. In such a case, one would extrude a hot thermoplastic reinforcing adhesive material on each side of the film sheet such that after cooling and pressing, it would form a band of predetermined width and thickness. The reinforced sheet is then passed over conventional tubing machinery such that the two bands or seams of reinforcing material overlap each other and an additional reinforcing layer of hot melt adhesive may be extruded between the two bands or seams to form a single wall tube or bag. The bag is thus reinforced at its critical points.

The means for securing the seams together can be made from various types of adhesives—e.g. isocyanate solvent glue, pure polyethylene extruded hot melt, and other specially formulated hot melt extruded adhesives. If desired, in some circumstances, heat sealing may be utilized between the reinforced seams or edges for securing the bag together whenever the extra reinforcing adhesive layer is deemed unnecessary.

Having thus generally described the invention, reference will be made to the accompanying drawings illustrating embodiments thereof in which.

Figure 5:
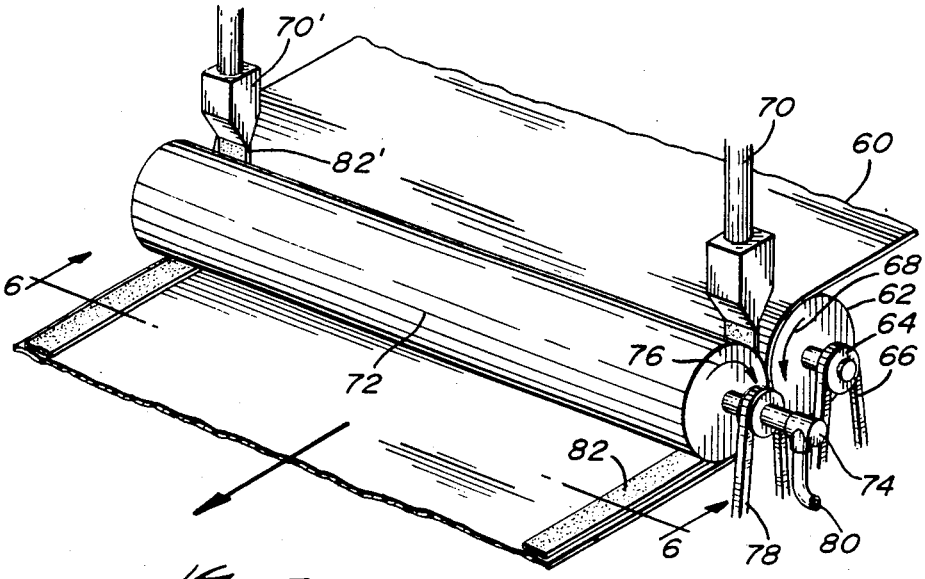
Figure 6:
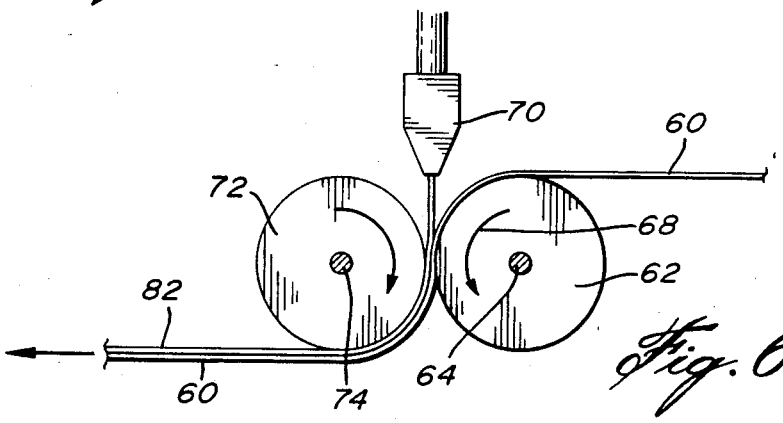

FIG. 5. is a perspective view of an apparatus used for forming a single walled tube;

FIG. 6 is a side view of FIG. 5; and

Figure 7:
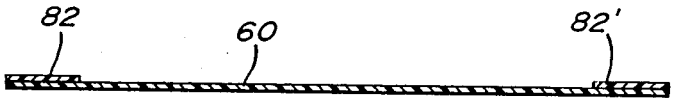

FIG. 7 is a cross-sectional view of the single walled film used in the embodiment of FIGS. 5 and 6 taken along the lines 6—6 of FIG. 5.

Figure 1:
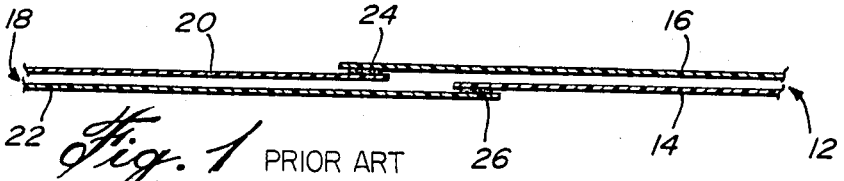
Fig. 1 PRIOR ART
FIG. 1 is a cross-sectional view of the seam area of a convention art double wall tube or bag.

Referring to the drawings in greater detail and by reference characters thereto, FIG. 1 illustrates a prior art sealing arrangement for a double wall tubed bag. In this arrangement, a first panel 12 having walls or layers 14 or 16 is overlapped with a second panel 18 having walls or layers 20 and 22. As may be seen from FIG. 1, the sealing arrangement is such that plies 20 and 22 are offset with respect to each other as are plies 14 and 16. The upper surface of ply 20 is secured to the lower surface of ply 16 by a strand of hot melt adhesive 24. Similarly, a strand of hot melt adhesive 26 secures the upper surface of ply 22 to the lower surface of ply 14. Thus, two separate sealing strands, offset from each other, are provided in the making of a double wall tubed bag.

Figure 4:
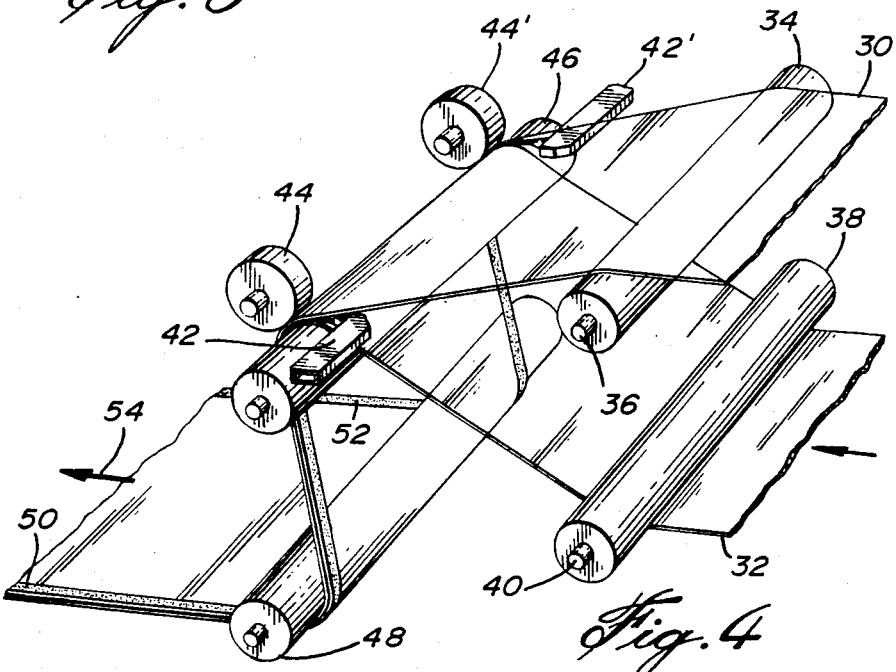
FIG. 4 is a perspective view of an apparatus for forming the double wall tube or bag of the present invention.

Thus, as shown in FIG. 4, a first film layer 30 is provided from a source of the same, is passed over guide roller 34 journalled on shaft 36. A second film layer 32 is similarly passed over guide roll 38 which is journalled on shaft 40. Layers 30 and 32 then converge to pass over roll 46 as may be seen in FIG. 4.

Before the point of convergement of layers 30 and 32, extruder nozzles 42, 42' are provided on each side of the sheet material 30, 32 and a layer of a suitable reinforcing adhesive material is applied to the facing surfaces of layers 30,32. Pressure rolls 44, 44' are situated at either side of the sheet material to convert the adhesive material into reinforcing bands of a predetermined width and thickness.

Thus, at either side of sheet material 30, 32 a reinforced area generally designated by reference numerals 50 and 52 is provided, at which reinforced area the films are thereby secured together. The double walled material is passed over guide roller 48 to a tuber, as designated by arrow 54. If necessary, a cooling roll may be added, e.g. when wide/thick reinforcing bands are used.

Figure 2:
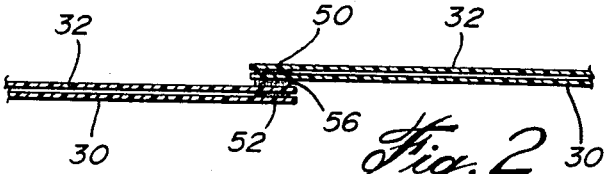
FIG. 2 is a cross-sectional view of the seam area of a double wall tube or bag according to the present invention.

At the tuber (not shown), the side edges or reinforced areas of the double walled material are overlapped in a conventional manner and are secured together, preferably by a hot melt adhesive reinforcing layer as described above. Thus, one obtains the structure shown in FIG. 2 wherein at the seam of the tube or bag, an extremely strong structure is obtained with a resin layer of reinforcing adhesive 56 joining the double walled reinforced structure together.

Figure 3:
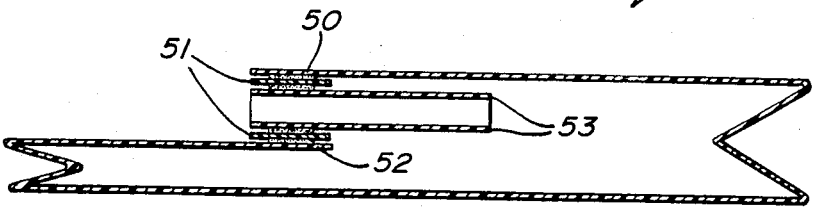
FIG. 3 is a cross-sectional view of the valve area of a double wall bag.

When forming a valve bag, valve components are inserted between the reinforced areas of the single or double walled material prior to securing the reinforced areas together in the tuber as is well known in the prior art. Thus, having reference to FIG. 3 illustrating the valve structure for a single wall bag, a first outer valve tube reinforcing component 51 is inserted between reinforced areas 50 and 52 formed from the above hot melt adhesive, and which component 51 is secured to the reinforced areas. In turn there is an inner valve component 53 secured to outer valve tube component 51. It is preferred that inner valve component 53 be of a thinner slightly more flexible material than outer valve component 51 and it will at the same time, extend into the interior of the tube or bag further than outer component 51. The method of adding the reinforced bands/layers 50 and 52 is illustrated in FIGS. 5, 6 and 7; the insertion of tubes 51 and 53 are not shown as the method for such an insertion is well known in the art. It is to be noted that all the adhesive bands/layers are lined up, one above the other.

The practice of the present invention can also be utilized in a single wall tube or bag to provide greater strength characteristics than conventional bags or tubes. When or if required, bags of more than two walls can also be made in accordance with this invention.

FIG. 5 illustrates the use of the method as it is applied to a single wall bag or tube. In this method, sheet material 60 is passed over a back-up roll 62 journalled on shaft 64 which is driven by means of belt 66. Back-up roll 62 rotates in the direction indicated by arrow 68. At either side of continuous film 60, are a pair of extruders 70, 70' extruding sufficient reinforcing adhesive material 82, 82' on an upper surface of the film 60 such that on being pressed in the nip formed between rolls 62 and 72, the material will form reinforcing bands of a predetermined width and thickness.

A cooling roll generally designated by reference numeral 72 rotates in the direction indicated by arrow 76 to drive belt 78 rotating shaft 74. Means generally designated by reference character 80 are utilized to provide a cooling fluid to the interior of cooling roll 72.

As will be appreciated, suitable inlet and outlet means for the cooling fluid are provided.

Following placement of reinforcing material 82, 82' on the side edges of film 60, the material is advanced to a conventional tuber (not shown) wherein the edges are overlapped and secured together. As in the case of the double wall tube or bag, a layer of hot melt adhesive is preferably utilized or if so desired a heat sealing operation may be used. If the plastic layer 51 of FIG. 3 is to be used, it can be fed into the nip formed by rolls 62 and 72; by adding a second hot melt station the remaining part of the valve 53 can also be fed into that second nip; the final hot melt layer would be added during the tuber section when the overlapped edges are joined together.

Utilizing the present invention, it is possible to use the above reinforced tubing as a plastic pipe conduit or gas pocket with the seams or reinforced edges being used to support the conduit or pocket such that nails, screws or other fasteners could be inserted in or attached to these seams whereby they can function as lugs. The straight double wall web/tube construction (i.e. as shown in FIG. 4 without going to the tuber) may be used in greenhouse construction wherein the space between the two walls can be filled with air for insulation purposes or alternatively for heating. Still further, the web/tube could be suitably inflated to provide cushioning or other effects where desired.

The bags of the present invention were then tested in comparison to bags manufactured according to the prior art teachings.

In test No. 1 double wall machine made gusseted bags (355 mm × 100 mm × 615 mm) were filled with 25 kgs of material and cooled in a deep freeze to the temperature indicated. The bags were then dropped 4 feet as per the type of drop indicated in Table 1. Bags 1 to 6 were gusseted bags of 5.7 mil thickness and manufactured according to the present invention; bags 7 and 8 were gusseted bags of 6 mil thickness manufactured according to the prior art. The results are as follows:

TABLE I

| Bag # | Flat Drop | Edge Drop | Valve Drop | Bottom Drop | Temp. °F. | Bag Failed at |
|---|---|---|---|---|---|---|
| 1 | 2 | 4 | 1 | 1 | +2 | Did not break |
| 2 | 4 | 6 | 1 | 1 | +4 | " |
| 3 | 4 | 4 | 2 | 4 | −4 | " |
| 4 | 4 | 4 | 2 | 4 | −4 | " |
| 5 | 4 | 4 | 2 | 3 | −2 | " |
| 6 | 4 | 4 | — | — | −2 | Bottom seal |
| 7 | 4 | 1 | — | — | +4 | Bottom seal |
| 8 | 4 | 1 | — | — | −4 | Top seal |

In a second test, the prior art bags and bags according to the present invention were filled with 25 kg of material, frozen and were dropped a distance of 4 feet at temperatures varying between −3° F. to +6° F. until they failed. The types of drops were varied. Gusseted bags (15⅛" × 25") formed of 3 mil material and being double wall according to the prior art failed after an average of 1.63 drops. Gusseted bags (12½" × 4" × 28") formed of 3 mil material and being double walled according to the present invention averaged 5.0 drops prior to failure.

As may be seen from the above results, it is apparent that the bags formed according to the present invention represent a substantial improvement over the teachings of the prior art. Thus, as previously discussed, the use of initially heat sealing and later hot melts still do not provide a bag with the characteristics of bags according to the present teachings.

It will be understood that the above described embodiments are for purposes of illustration only and that changes and modifications may be made thereto without departing from the spirit and scope of the invention.

We claim:

1. A method of forming a plastic bag having a reinforced seam area from double wall tubing comprising the steps of feeding at least first and second layers of a thermoplastic sheet material into proximity to each other, said first and second layers having their side edges generally in alignment, extruding a layer of reinforcing material on at least one facing surface of at least one layer of sheet material at each side edge thereof in a continuous in-line operation, said layer of reinforcing material being extruded in the form of a band of a predetermined width and thickness which is sufficient to form and function as a reinforcing layer to reinforce the adjoined edges juxtaposing and adhering said side edges together such that said first and second layers of sheet material form a double wall structure having said first and second layers spaced apart at their edges by said layer of reinforcing material and where the layer of reinforcing material still retains sufficient width and thickness after adhering said side edges together to function as a reinforcing layer in the bag, folding one of said pair of adhered edges over to form a double wall tube with said adhered edges overlapping each other, extruding a further layer of reinforcing material on a facing surface of at least one of said overlapped edges, and securing said overlapped edges together along at least a portion of the length of said secured edges overlapped to thereby form a tubing structure having four layers of overlapped sheet material with a reinforcing layer intermediate each adjacent sheet material.

2. The method of claim 1 wherein said reinforcing layer has a width of between 5 to 50 mm and a thickness of between 2 to 5 mils.

3. The method of claim 1 wherein the step of extruding a layer of reinforcing material on said films comprises the step of extruding a layer of hot melt adhesive thereon and adhering said first and second sheet material layers together.

4. The method of claim 3 wherein said first and second layers of thermoplastic material are a polyethylene material.

5. The method of claim 2 further including the step of passing said side edges between a pair of pressure rolls and applying sufficient pressure to adhere the first and second layers together but with the layer of reinforcing material retaining a sufficient width and thickness to function as a reinforcing layer.

6. The method of claim 1 further including the step of placing a valve component intermediate said overlapped edges and extruding a layer of reinforcing material between an outer surface of said valve component and an overlapped edge and securing said valve component to said overlapped edge, and where said reinforcing layer around said valve component also has sufficient thickness to function as a reinforcing layer to reinforce the securing of the valve component.

7. The method of claim 6 wherein said valve component comprises inner and outer sleeves with the inner sleeve being formed of a thinner more flexible material than said outer sleeve, the method including the step of securing said outer sleeve to said overlapped edge while permitting said inner sleeve to extend inwardly a greater distance than said outer sleeve.

8. The method of claim 1 wherein at least one additional layer of reinforcing material is extruded upon each of the first material layers of reinforcing material before the first and second layers of sheet material are juxtaposed and adhered.

9. A method of forming a valve bag having a reinforced valve area from double wall tubing comprising the steps of feeding at least first and second layers of a thermoplastic sheet material into proximity to each other, said first and second layers having their side edges generally in alignment, extruding a layer of reinforcing material on at least one facing surface of at least one layer of sheet material at each side edge thereof in a continuous in-line operation, said layer of reinforcing material being extruded in the form of a band of a predetermined width of between 5 to 50 mm and thickness of between 2 to 5 mils which is sufficient to form and function as a reinforcing layer to reinforce the adjoined edges; juxtaposing said side edges with respect to each other, passing the juxtaposed side edges through a pair of pressure rolls which apply sufficient pressure to adhere the first and second layers together, such that said first and second layers of sheet material form a double wall structure having said first and second layers spaced apart at their edges by said layer of reinforcing material, and where the layer of reinforcing material still retains sufficient width and thickness after adhering said side edges together to function as a reinforcing layer in the bag, folding one of said pair of adhered edges over to form a double wall tube with said adhered edges overlapping each other, extruding a further layer of reinforcing material on a facing surface of at least one of said overlapped edges, and securing said overlapped edges together along at least a portion of the length of said secured edges overlapped to thereby form a tubing structure having four layers of overlapped sheet material with a reinforcing layer intermediate each adjacent sheet material layer.

10. A method of forming a valve bag having a reinforced valve area from double wall tubing comprising the steps of feeding at least first and second layers of thermoplastic sheet material into proximity to each other, said first and second layers having their side edges generally in alignment, extruding a layer of reinforcing material on at least one facing surface of at least one layer of sheet material at each side edge thereof in a continuous in-line operation, said layer of reinforcing material being extruded in the form of a band of a predetermined width of between 5 to 50 mm of and thickness of between 2 to 5 mils which is sufficient to form and function as a reinforcing layer to reinforce the adjoined edges; juxtaposing said side edges with respect to each other, passing the juxtaposed side edges through a pair of pressure rolls which apply sufficient pressure to adhere the first and second layer together, such that said first and second layers of sheet material form a double wall structure having said first and second layers spaced apart at their edges by said layer of reinforcing material and where the layer of reinforcing material still retains sufficient width and thickness after adhering said side edges together to function as a reinforcing layer in the bag, folding one of said pair of adhered edges over to form a double wall tube with said adhered edges overlapping each other, extruding a further layer of reinforcing material on a facing surface of at least one of said overlapped edges, placing a valve component intermediate said overlapped edges and extruding a layer of reinforcing material between an outer surface of said valve component and an overlapped edge and securing said valve component to said overlapped edge, and where said reinforcing layer around said valve component, has sufficient thickness to function as a reinforcing layer to reinforce the securing of the valve component, said valve component comprising inner and outer sleeves, securing said outer sleeve to said overlapped edge while permitting said inner sleeve to extend inwardly a greater distance than said outer sleeve, and securing said overlapped edges together along at least a portion of the length of said secured edges overlapped to thereby form a tubing structure having four layers of overlapped sheet material with a reinforcing layer intermediate each adjacent sheet material layer.

* * * * *